US005796058A

United States Patent [19]

Aimi et al.

[11] Patent Number: 5,796,058

[45] Date of Patent: Aug. 18, 1998

[54] LEVER OPERATED SLIDE SWITCH

[75] Inventors: Mitsuo Aimi; Masayoshi Nishida, both of Osaka, Japan

[73] Assignee: Matsushita Electric Industrial Co., Ltd., Osaka, Japan

[21] Appl. No.: 655,837

[22] Filed: May 31, 1996

[30] Foreign Application Priority Data

Jun. 6, 1995 [JP] Japan ..... 7-139084

[51] Int. Cl.[6] ..... H01H 15/00

[52] U.S. Cl. ..... 200/16 D; 200/6 R; 200/553

[58] Field of Search ..... 200/6 R, 5 R, 200/6 A, 6 C, 11 R, 11 A, 16 D, 238–245, 275, 433–436, 409, 553, 562

[56] References Cited

U.S. PATENT DOCUMENTS

| | | | |
|---|---|---|---|
| 2,463,945 | 3/1949 | Booth | 200/6 R |
| 3,614,362 | 10/1971 | Keranen | 200/315 |
| 3,689,714 | 9/1972 | Walz | 200/16 D X |
| 3,691,325 | 9/1972 | Bognar | 200/6 C |
| 3,900,711 | 8/1975 | Holland | 200/238 |
| 3,912,895 | 10/1975 | Plana | 200/339 X |
| 3,946,185 | 3/1976 | Gruner | 200/245 |
| 3,996,433 | 12/1976 | Suzuki et al. | 200/61.27 |
| 4,041,258 | 8/1977 | Harada | 200/6 A |
| 4,364,047 | 12/1982 | Archer | 200/6 A |
| 4,454,396 | 6/1984 | Neese | 200/6 R X |
| 4,590,387 | 5/1986 | Yoshida et al. | 200/50.34 |
| 4,612,422 | 9/1986 | Rose et al. | 200/409 |
| 5,075,516 | 12/1991 | Brouillette | 200/5 R |
| 5,200,584 | 4/1993 | Nagaya | 200/4 |

FOREIGN PATENT DOCUMENTS

| | | | |
|---|---|---|---|
| 0262509 | 4/1988 | European Pat. Off. | H01H 23/02 |
| 1371571 | 10/1974 | United Kingdom | H01H 23/24 |
| 1433616 | 4/1976 | United Kingdom | H01H 23/26 |
| 1559531 | 1/1980 | United Kingdom | H01H 23/00 |
| 2097591 | 11/1982 | United Kingdom | H01H 15/02 |
| 2257833 | 1/1993 | United Kingdom | H01H 23/26 |

*Primary Examiner*—J. R. Scott

*Attorney, Agent, or Firm*—Pollock, Vande Sande & Priddy

[57] ABSTRACT

A casing 1 has an inside bottom and an open top. Fixed terminals 2 and 3, having stationary contacts 2*a* and 3*a*, are provided on the inside bottom of casing 1. An operational lever 5 is swingably supported at the upper part of casing 1. A contact piece 4, made of a resilient thin plate formed into a U-shaped configuration, has a base end engageable with the pivot portion of operational lever 5 and a movable portion 4*f* brought into contact with the lower surface of operational lever 5. The distal end of contact piece 4 is provided with movable contacts 4*b* and 4*c* which are slidably brought into contact with stationary contacts 2*a* and 3*a*.

11 Claims, 13 Drawing Sheets

LEVER OPERATED SLIDE SWITCH

BACKGROUND OF THE INVENTION

1. Field of the Invention

The present invention generally relates to a lever switch used for controlling various electronic devices.

2. Prior Art

This kind of conventional lever switch will be hereinafter explained with reference to FIGS. 20 through 24.

In the drawings, a casing 101 has an inside bottom surface on which stationary terminals 102 and 103 are flatly provided. A U-shaped recess 101*a* is formed on the bottom of casing 101 to support a coil portion 104*e* of a contact piece 104.

Contact piece 104, made of a resilient and conductive torsion coil spring member, comprises a movable end 104*b* bent in a U-shaped configuration and having a semi-circular contact 104*c* at its distal end, and a stationary end 104*a* substantially extending straight and provided with a contact 104*d* at its distal end which is brought into contact with the stationary contact 102.

An operational lever 105, being a molding member, is coupled by boss 105*a* into the recess 101*a* provided in the casing 101 so as to be rotatable. The movable end 104*b* of contact piece 104 is brought into contact with the lower surface of this operational lever 105.

An operation of the above-described conventional lever switch will be explained hereinafter.

FIG. 21 shows a normal condition of the above-described conventional lever switch. When operational lever 105 is depressed down causing a swing movement about a rotational center 105*a*, movable end 104*b* of contact piece 104 causes a rotation and contact 104*c* is brought into contact with stationary terminal 103, thus establishing an ON condition as shown in FIG. 23.

When operational lever 105 is further depressed down, contact 104*c* slides on stationary terminal 103 in the "X" direction while keeping an electrical contact with stationary terminal 103, then finally establishing a complete condition of FIG. 24.

If operational lever 105 is released from the depression force, it returns back to its normal condition of FIG. 21 by the restoring force given from contact piece 104, thereby accomplishing a series of switching operations.

However, according to the arrangement of the above-described conventional lever switch, there was a problem that contact piece 104 had a tendency to entangle due to its coil spring nature. Hence, it is difficult to realize an automatic supply of contact piece 104. Furthermore, the configuration of contact piece 104 is complicated and expensive to manufacture. In addition, the accuracy of the switch-ON position depends on the bending angle of the U-shaped portion of movable end 104*b* of contact piece 104 which is difficult to assure accuracy during manufacturing. Hence, it was not possible to provide a stable on-stroke for the switching operation.

Furthermore, in the assembling of contact piece 104, there was a possibility that contact piece 104 might be deformed because movable end 104*b* of contact piece 104 extends perpendicularly to the bottom surface. Moreover, contact 104*c* of movable end 104*b* is not brought into contact with stationary terminal 103 unless operational lever 105 is depressed down by a significant amount of stroke. Hence, the operational force is suddenly changed when contact 104*c* of movable end 104*b* is first brought into contact with stationary terminal 103 during the depressing stroke. Such a sudden change of the operational force will give an operator an awkward operational feel of the lever switch. Furthermore, a contact pressure acting between the contacts is so small that the electrical contact between the contacts cannot be stabilized during the on-stroke of the switching operation.

Further, the U-shaped recess 101*a* receiving coil portion 104*e* of contact piece 104 is disposed in parallel with stationary terminals 102 and 103 on the bottom of casing 101. Such a layout is disadvantageous in that the overall width of the switch is enlarged. When this switch is used under the face-laid-down condition for surface mounting, the width of the switch is the mounting height. Thus, the reduction of the width of this type of conventional switch was very difficult.

SUMMARY OF THE INVENTION

Accordingly, in view of above-described problems encountered in the prior art, a principal object of the present invention is to provide a lever switch which is thin in width, has an excellent operational feel, and is accurate in the on-stroke of the switching operation.

In order to accomplish this and other related objects, the present invention provides a lever switch comprising: a casing shaped into a box-like configuration with an open top and an inside bottom; a terminal-with a stationary contact provided on the inside bottom of the casing; an operational lever inserted from the open top of the casing and swingably supported on an upper part of the casing; and a contact piece resiliently deformable and disposed under the operational lever, the contact piece being formed into a U-shaped configuration and having one end provided with a movable contact which is brought into contact with the stationary contact of the terminal provided on the inside bottom of the casing.

With this arrangement, the contact piece is integrated with the operational lever and causes a rotation in response to a rotation of the operational lever. Hence, it becomes possible to assure a large operational stroke with a relatively small deflection of the contact piece, preventing the contact piece from being plastically deformed.

Furthermore, it becomes possible to provide a contact piece which is easy to manufacture and is inexpensive. In the assembling, the contact piece can be supplied in the hoop condition. The contact piece and the casing (a point of action and a movable contact portion) are always brought into slidable contact with each other along the inside surface of the casing, providing a stable operational force and a better feeling during the switching operation. Further, the on-stroke accuracy can be maintained at a higher value, since the accuracy of the contact piece can be increased and the on-stroke accuracy does not depend on the bending accuracy of the contact piece.

According to the features of preferred embodiments of the present invention, the inside bottom of the casing has an inclined surface ascending from a far side to a near side with respect to a rotational center of the operational lever, so that the inclined surface is high at a portion near the rotational center of the operational lever and low at a portion near a distal end of the operational lever.

It is preferable that the contact piece is made of a thin plate and has one end separated into a plurality of ligulate pieces with movable contacts at the distal ends thereof and the other end formed into an engaging portion engageable with the operational lever.

It is also preferable that the terminal with the stationary contact is provided on an inside wall of the casing, while the movable contact is provided on a ligulate piece bent perpendicularly from the contact piece of a thin plate so as to extend toward the inside wall and to be resiliently brought into contact with the stationary contact.

It is further preferable that the contact piece is made of a resiliently deformable wire so as to form a pair of U-shaped contact legs extending in parallel with each other, and the movable contact is formed on a distal end of each contact leg.

It is still preferable that the operational lever is provided with a pivot boss serving as the rotational center of the operational lever, the contact piece has a pair of plates bent and raised from opposing sides of a base end of the contact piece, and a bearing hole is opened on the center of each plate so that the pivot boss is engaged with the bearing hole.

It is further preferable that a base end of the contact piece is insert molded into the operational lever.

It is also preferable that the contact lever is made of a resilient flat plate and separated into a plurality of ligulate pieces extending from its base end in a cantilever fashion, and at least one of the ligulate pieces is engaged at its distal end to the operational lever.

It is yet preferable that the contact piece includes a plurality of ligulate pieces having movable contacts on the distal ends thereof, and at least one of the ligulate pieces is shorter than others.

It is also preferable that the inside bottom of the casing has a plurality of steps, and the movable contact of the contact piece is always placed on a higher step while a U-shaped portion of the contact piece enters into a space formed above a lower step when the operational lever is depressed down.

BRIEF DESCRIPTION OF THE DRAWINGS

The above and other objects, features and advantages of the present invention will become more apparent from the following detailed description which is to be read in conjunction with the accompanying drawings, in which.

DETAILED DESCRIPTION OF THE PREFERRED EMBODIMENTS

Figure 1:
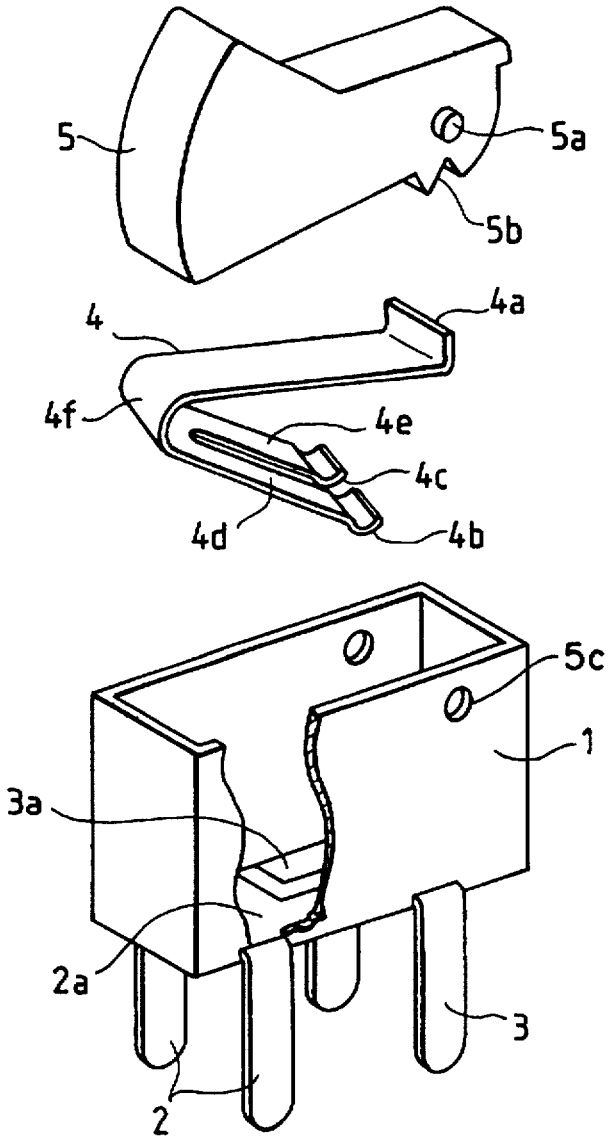
FIG. 1 is an exploded perspective view showing a lever switch in accordance with a first embodiment of the present invention.
Figure 2:
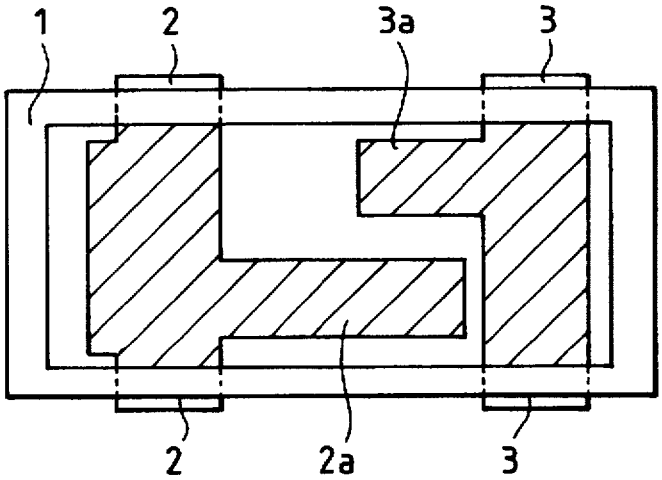
FIG. 2 is a plan view showing a bottom of a casing of the lever switch in accordance with the first embodiment of the present invention.
Figure 3:
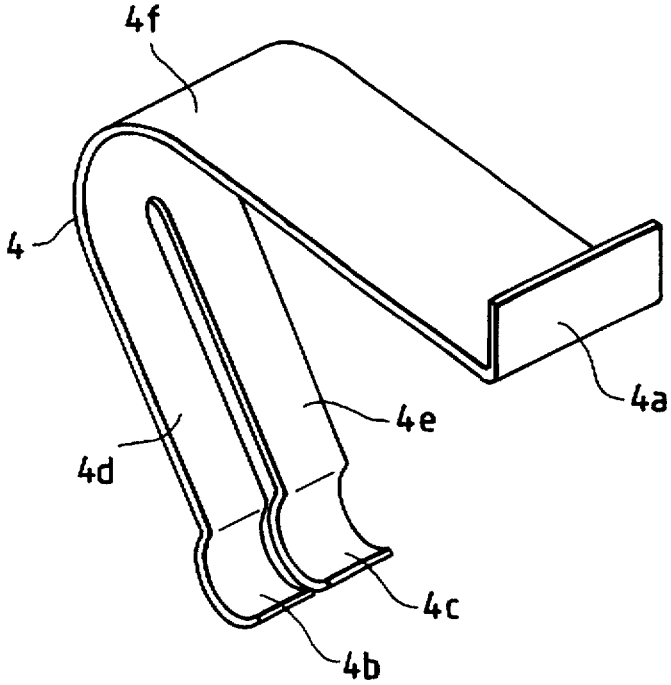
FIG. 3 is a perspective view showing an overall configuration of a contact piece of the lever switch in accordance with the first embodiment of the present invention.

Preferred embodiments of the present invention will be explained in greater detail hereinafter, with reference to the accompanying drawings. Identical parts are denoted by the same identical reference numeral throughout views.

First Embodiment

A first embodiment of the present invention will be explained with reference to FIGS. 1 through 6.

A rectangular box-like casing 1 has an open top and an inside bottom. On the inside bottom of casing 1, a stationary contact 2*a* of a fixed terminal 2 and a stationary contact 3*a* of a fixed terminal 3 are flatly provided. A contact piece 4, made of an elastically deformable and conductive thin plate, comprises an engaging portion 4*a* bent upward from a base end thereof, a movable portion 4*f* bent downward at a middle thereof in a U-shaped configuration, and ligulate pieces 4*d* and 4*e* bifurcated at a remote end thereof so as to have movable contacts 4*b*, 4*c* at distal ends thereof.

An operational lever 5, being a molding member, is inserted from the open top of casing 1 and swingably supported at an upper part of the side wall of casing 1 through pivot boss 5*a* formed on the side surfaces thereof. Movable portion 4*f* of contact piece 4 is brought into contact with the lower surface of operational lever 5. Operational lever 5 has a notch 5*b* at the lower end of pivot boss 5*a*. Engaging portion 4*a* of contact piece 4 is engaged with notch 5*b* of operational lever 5.

Operational lever 5 rotates together with contact piece 4 about pivot boss 5*a* supported in hole 5*c*, so as to bring movable contacts 4*b* and 4*c* into forcible contact with stationary contacts 2*a* and 3*a* of fixed terminals 2 and 3, respectively.

An operation of the lever switch of the first embodiment will be explained hereinafter with reference to FIGS. 4 through 6.

Figure 4:
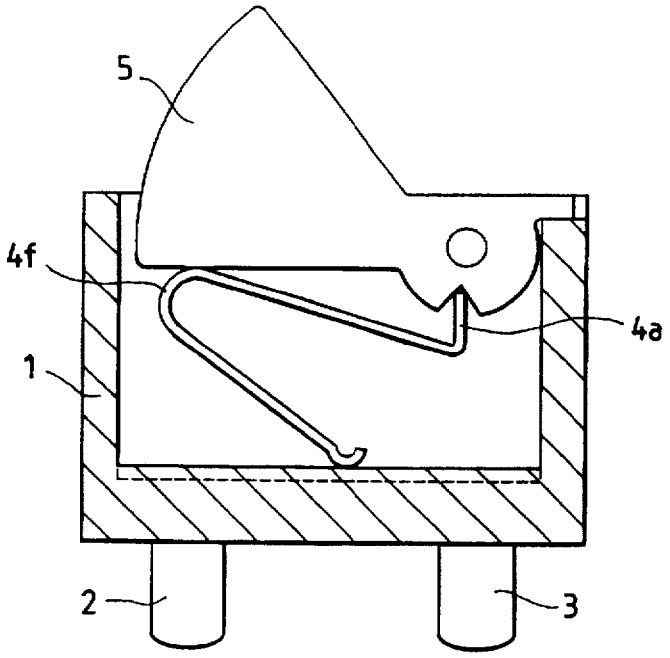
FIG. 4 is a cross-sectional side view showing a normal condition of the lever switch in accordance with the first embodiment of the present invention.
Figure 5:
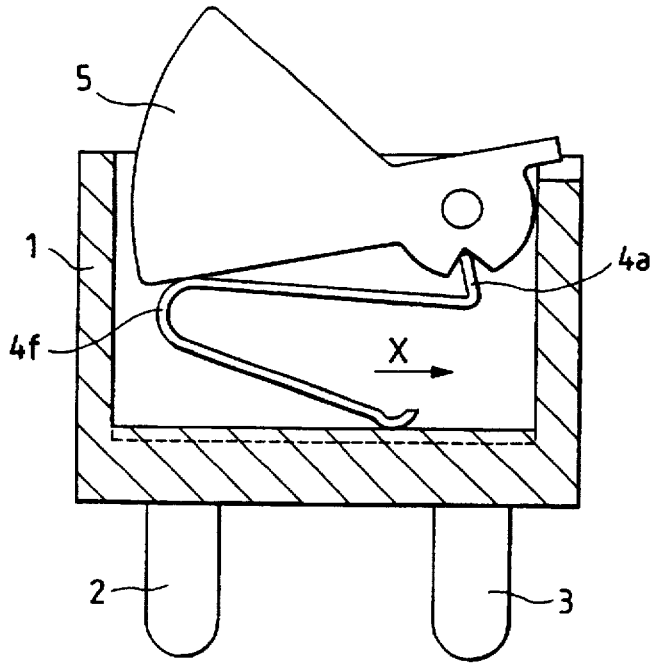
FIG. 5 is a cross-sectional side view showing a transitional condition of the lever switch in accordance with the first embodiment of the present invention, where an operational lever is depressed to an intermediate position.

FIG. 4 shows a normal condition of the lever switch. In this normal condition, movable contact 4*b* is always brought into contact with stationary contact 2*a*.

When operational lever 5 is depressed down, movable portion 4*f* causes a rotation about pivot boss 5*a* of operational lever 5 while movable contact 4*b* continuously keeps electrical contact with stationary contact 2*a*. Meanwhile, movable contact 4*c* is brought into contact with stationary contact 3*a*, establishing the turning-on condition of FIG. 5. If operational lever 5 is further depressed, movable contact 4*c* keeps contact with and slides on stationary contact 3*a* in the direction of "X", then finally establishing the condition of FIG. 6.

In this rotational movement, a reaction force "F" is generated between engaging portion 4 and movable contacts 4*b*, 4*c* in accordance with a deflection "A" of elastically deformable contact piece 4.

Figure 6:
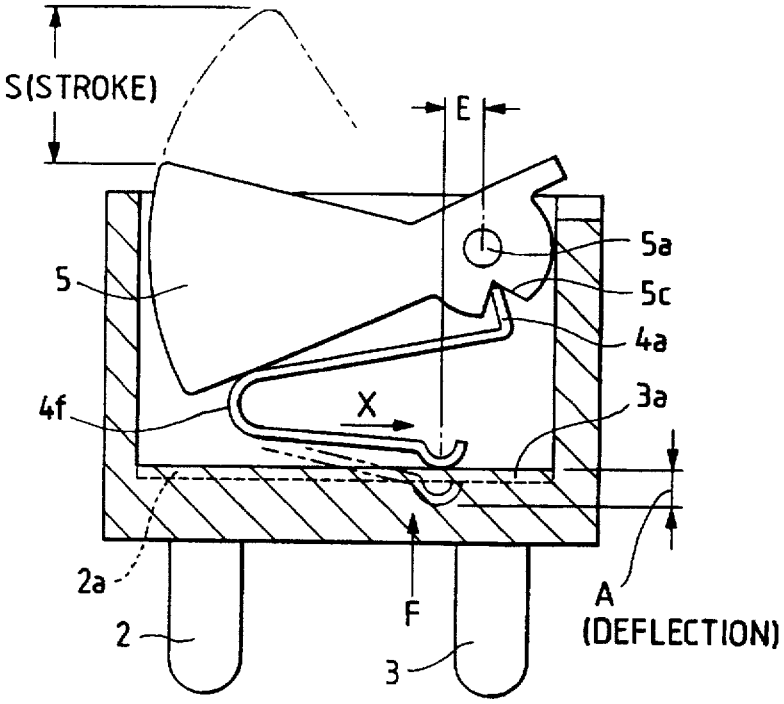
FIG. 6 is a cross-sectional side view showing a final condition of the lever switch in accordance with the first embodiment of the present invention, where the operational lever is in a full-stroke position.

When the distance "E", which is a distance measured from pivot boss 5*a* of operational lever 5 to movable contacts 4*b*, 4*c*, is positive (E>0, when the left side of engaging portion 4*a* is assumed to be positive in FIG. 6), a rotational moment E×F is generated in the clockwise direction. Accordingly, when operational lever 5 is released from the depression force, it returns back to the original (normal) condition of FIG. 4 being urged by a restoring force of contact piece 4, thereby accomplishing a series of switching operations.

According to the above-described first embodiment, contact piece 4 causes a rotation about pivot boss 5*a* of operational lever 5. Hence, a large operational stroke can be obtained with a relatively small deflection of contact piece 4. Accordingly, contact piece 4 is free from plastic deformation and, therefore, can be made of a metallic thin plate which is easy to manufacture and inexpensive in cost, and supplied as a hoop in the assembling which speeds up and facilitates automatic assembling.

Furthermore, as movable contacts 4*b* and 4*c* are always brought into slidable contact with the bottom surface of casing 1, the slide movement of such movable contacts 4*b* and 4*c* provides a stable operational force and assures a good operational feeling during switching operation. Furthermore, the on-stroke accuracy of the operational portion does not depend on the manufacturing accuracy in bending contact piece 4, assuring excellent accuracy.

Second Embodiment

Figure 7:
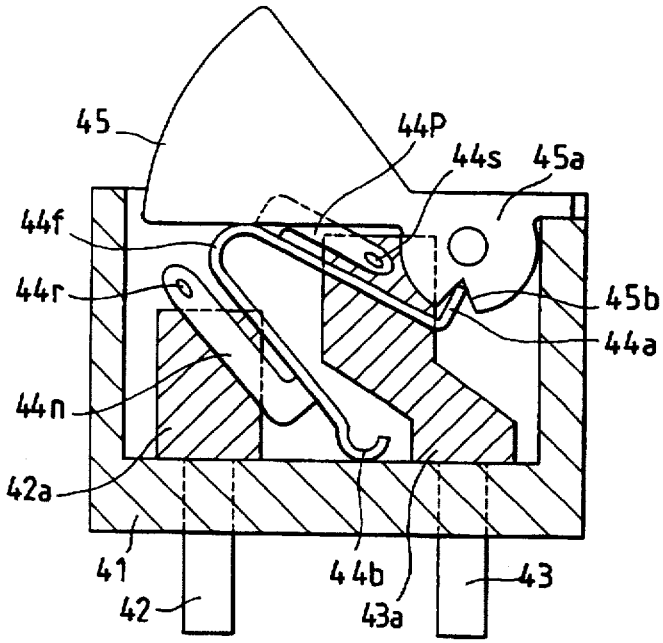
FIG. 7 is a cross-sectional side view showing a lever switch in accordance with a second embodiment of the present invention.
Figure 8:
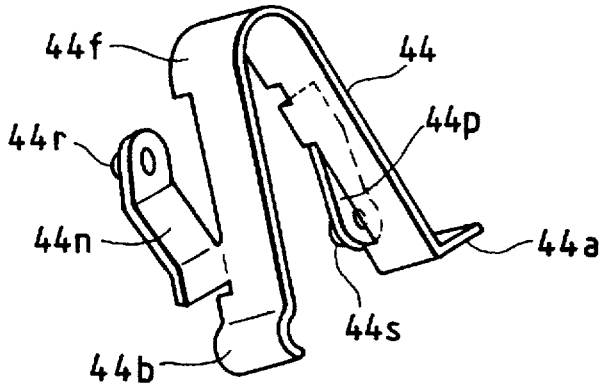
FIG. 8 is a perspective view showing the configuration of a contact piece of the lever switch in accordance with the second embodiment of the present invention.

A lever switch in accordance with a second embodiment of the present invention will be explained with reference to FIGS. 7 and 8. Reference numerals 42 and 43 represent fixed terminals which are insert molded in a casing 41 along the surface parallel to the operational direction of an operational lever 45. A contact piece 44, made of an elastically deformable and conductive thin plate, comprises an engaging portion 44*a* bent upward from a base end thereof, a movable portion 44*f* bent downward at a middle thereof in a U-shaped configuration, and a slide portion 44*b* formed at a remote end thereof.

Two ligulate pieces 44*n* and 44*p* are branched and bent perpendicularly from the side of contact piece 44, so as to extend in arbitral directions. Movable contacts 44*r* and 44*s* are provided at the remote ends of ligulate pieces 44*n* and 44*p*. Movable contact 44*r* slides on a stationary contact 42*a* of fixed terminal 42 and the other movable contact 44*s* slides on stationary contact 43*a* of fixed terminal 43, when operational lever 45 is depressed down so as to cause a swing movement about its hinge center 45*a*. Engaging portion 44*a* of contact piece 44 is engaged with a notch 45*b* formed at the lower part of hinge center 45*a* of operational lever 45. Movable portion 44*f* of contact piece 44 is brought into contact with the lower surface of operational lever 45. When operational lever 45 is depressed down, contact piece 44 is elastically deformed causing a swing motion about the engaging portion 44*a* while slide portion 44*b* slides along the bottom surface of casing 41.

In other words, the lever switch of the second embodiment is characterized in that stationary contacts (42*a*, 43*a*) are provided flatly on a side surface of the casing (41) and movable contacts (44*r*, 44*s*) extend from elastically deformable contact piece (44) toward the side surface of the casing (44) so as to be brought into contact with stationary contacts (42*a*, 43*a*) formed thereon.

This arrangement is advantageous in that the width of the switch casing can be thinned. As terminals 42 and 43 are integrally provided along the side surface of the casing by insert molding, the configuration of the metal mold can be simplified and the installation of terminals 42 and 43 can be facilitated.

Third Embodiment

Figure 9:
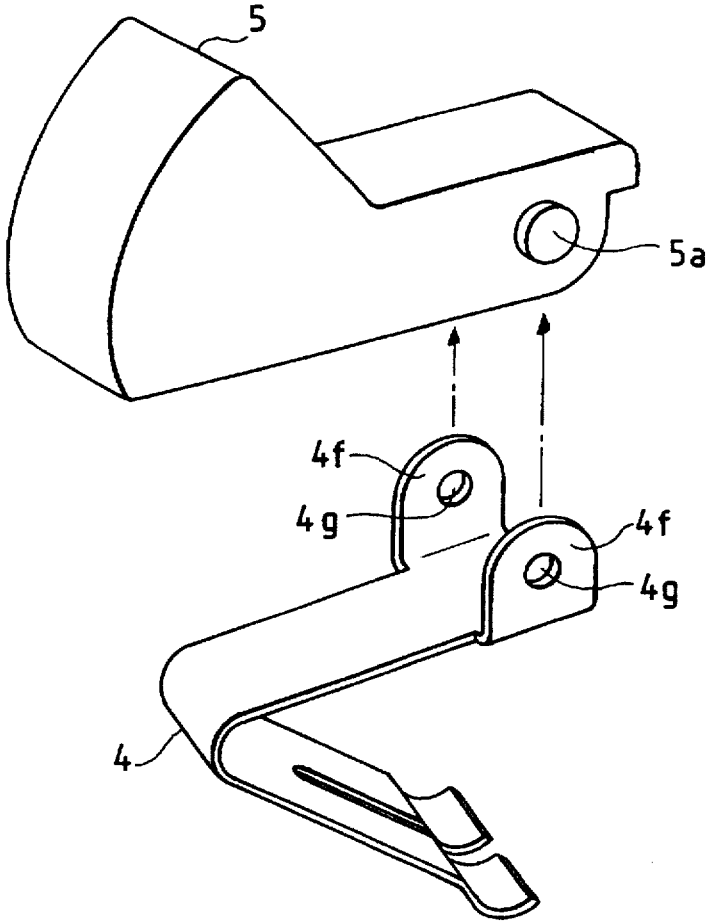
FIG. 9 is an exploded perspective view showing an operational lever and a contact piece of a lever switch in accordance with a third embodiment of the present invention.

A lever switch in accordance with a third embodiment of the present invention will be explained with reference to FIG. 9.

The third embodiment is different from the first embodiment in the fixing structure of contact piece 4 to operational lever 5. More specifically, contact piece 4 has a pair of parallel plates 4*f* and 4*f* bent perpendicularly from opposing sides of the base end of contact piece 4. A bearing hole 4*g* is opened on the center of each plate 4*f*. The pivot boss 5*a* of operational lever 5 is inserted into the bearing hole 4*g*, at both sides thereof.

Fourth Embodiment

Figure 10:
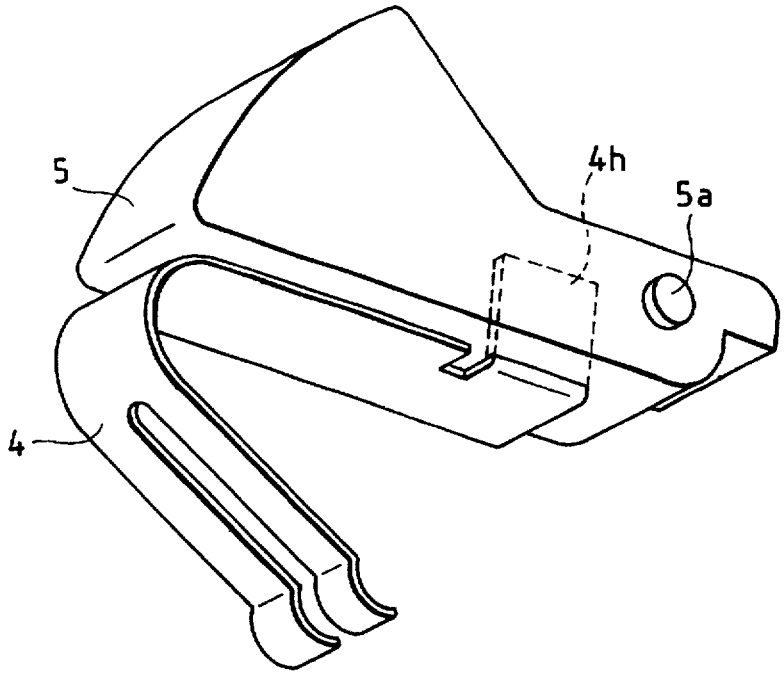
FIG. 10 is a perspective view showing an operational lever and a contact piece of a lever switch in accordance with a fourth embodiment of the present invention.

A lever switch in accordance with a fourth embodiment of the present invention will be explained with reference to FIG. 10.

The fourth embodiment is different from the first embodiment in the fixing structure of contact piece 4 to operational lever 5. More specifically, contact piece 4 has a plate 4*h* bent perpendicularly from the side of the base end of contact piece 4. This plate 4*h* is insert molded into the operational lever 5 in the vicinity of pivot boss 5*a*.

Fifth Embodiment

Figure 11:
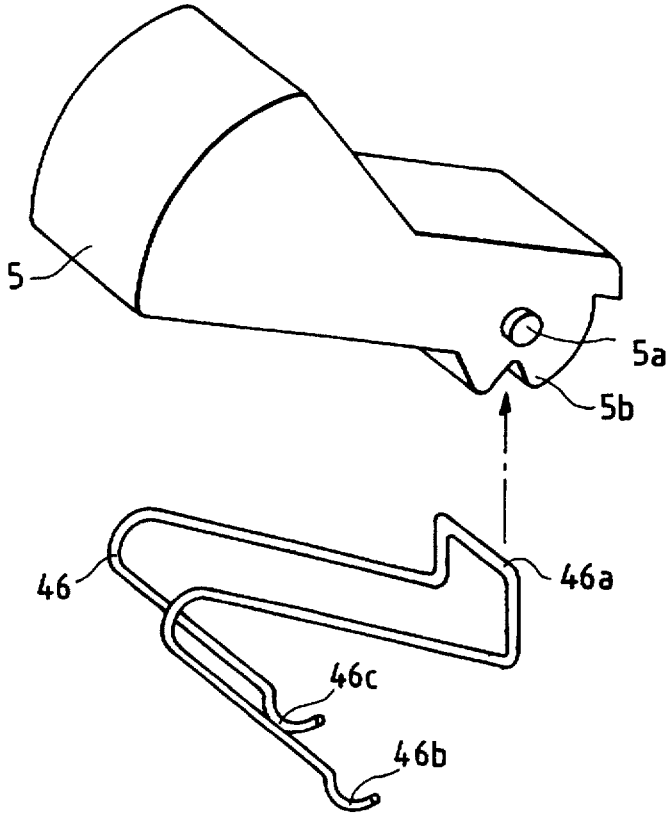
FIG. 11 is a perspective view showing an operational lever and a contact piece of a lever switch in accordance with the fifth embodiment of the present invention.

A lever switch in accordance with a fifth embodiment of the present invention will be explained with reference to FIG. 11.

The fifth embodiment is different from the first embodiment in the configuration of a contact piece. More specifically, a contact piece 46 is made of a resiliently deformable wire. A contact piece 46 has an engaging portion 46*a* bent upward at the base end thereof, and a pair of U-shaped contact legs extending from both ends of engaging portion 46*a* in parallel with each other. Semi-circular movable contacts 46*b* and 46*c* are provided at distal ends of the contact piece 46. Engaging portion 46*a* is engaged with notch 5*b* of operational lever 5.

Sixth Embodiment

Figure 12:
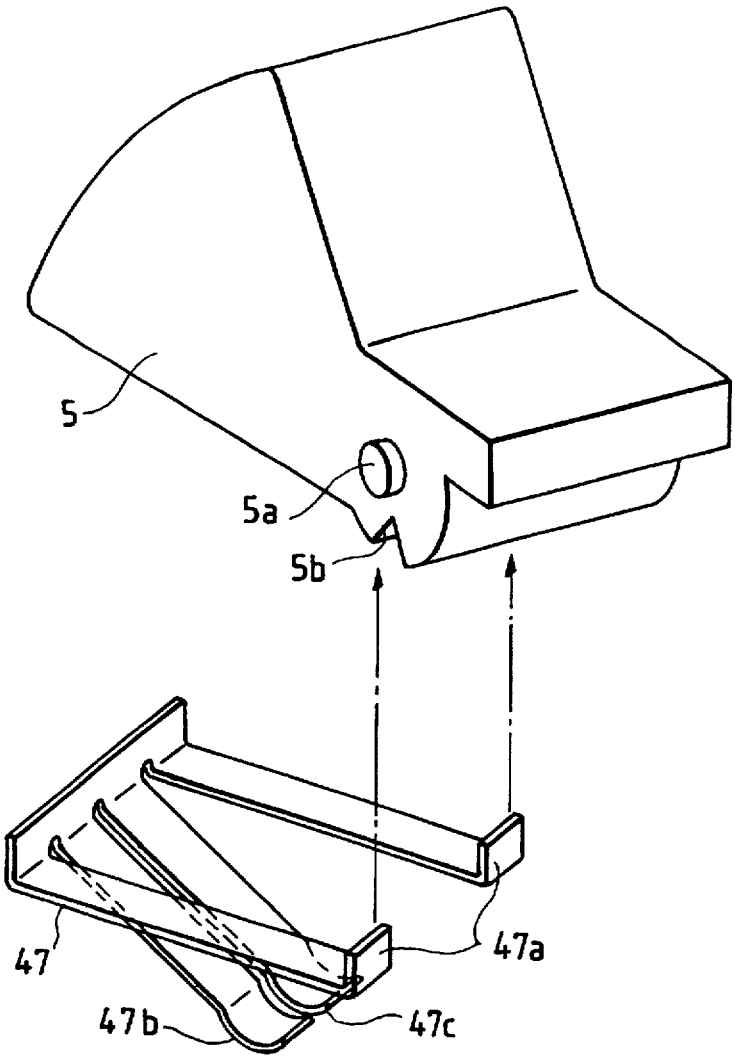
FIG. 12 is a perspective view showing an operational lever and a contact piece of a lever switch in accordance with the sixth embodiment of the present invention.

A lever switch in accordance with a sixth embodiment of the present invention will be explained with reference to FIG. 12.

The sixth embodiment is different from the first embodiment in the configuration of a contact piece. More specifically, a contact piece 47 is made of a resilient and conductive flat thin plate. A contact piece 47 is separated into a total of four ligulate pieces extending from its base end in a cantilever fashion. Of these four ligulate pieces, two outer ligulate pieces 47*a* are bent upward at their remote ends so as to be engaged with notch 5*b* formed at the lower end of operational lever 5. The inner two ligulate pieces extend downward obliquely and curved at their remote end so as to form movable contacts 47*b* and 47*c* of semi-circular shape.

Seventh Embodiment

Figure 13:
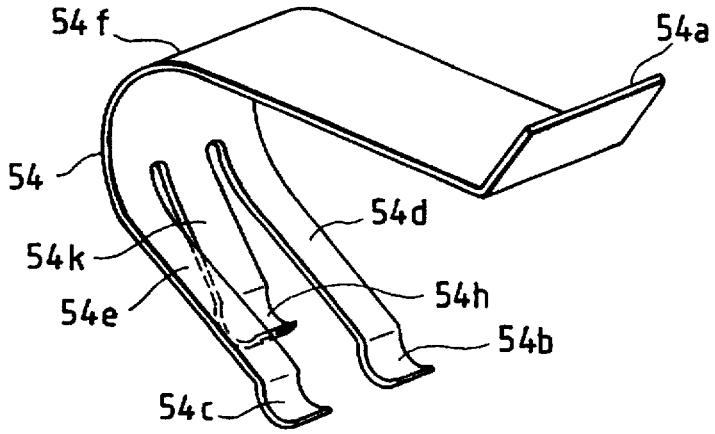
FIG. 13 is a perspective view showing a contact piece of a lever switch in accordance with the seventh embodiment of the present invention.

A lever switch in accordance with a seventh embodiment of the present invention will be explained with reference to FIG. 13.

The seventh embodiment is different from the first embodiment in the configuration of a contact piece. More specifically, a contact piece 54 is made of a resiliently deformable and conductive thin plate. A contact piece 54, curved into a U-shaped configuration, comprises an engaging portion 54*a* bent upward from a base end thereof, a movable portion 54*f* bent downward at a middle thereof in a U-shaped configuration, and a total of three ligulate pieces 54*d*, 54*e* and 54*k* extending toward the remote end thereof in a cantilever fashion.

Two outer ligulate pieces 54*d* and 54*e* have semi-circular movable contacts 54*b*, 54*c* at distal ends thereof. The central ligulate piece 54*k* is shorter than and inclined downward with respect to two outer ligulate pieces 54*d* and 54*e*.

Provision of central ligulate piece 54*k* is effective to give an additional restoring force. Even if the distance E is extremely small or a negative value in FIG. 6, a sufficient restoring force can be obtained by additional ligulate piece 54*k*.

Furthermore, it will be possible to use this ligulate piece 54*k* as a third movable contact. In this case, a movable contact 54*h* is formed at the distal end of ligulate piece 54*k*, while a stationary contact will be provided on the bottom surface of the casing so as to be brought into contact with movable contact 54*h*.

Eighth Embodiment

Hereinafter, embodiments of an other types of lever switches will be explained for providing relatively larger shifting strokes for their operational levers.

Figure 18:
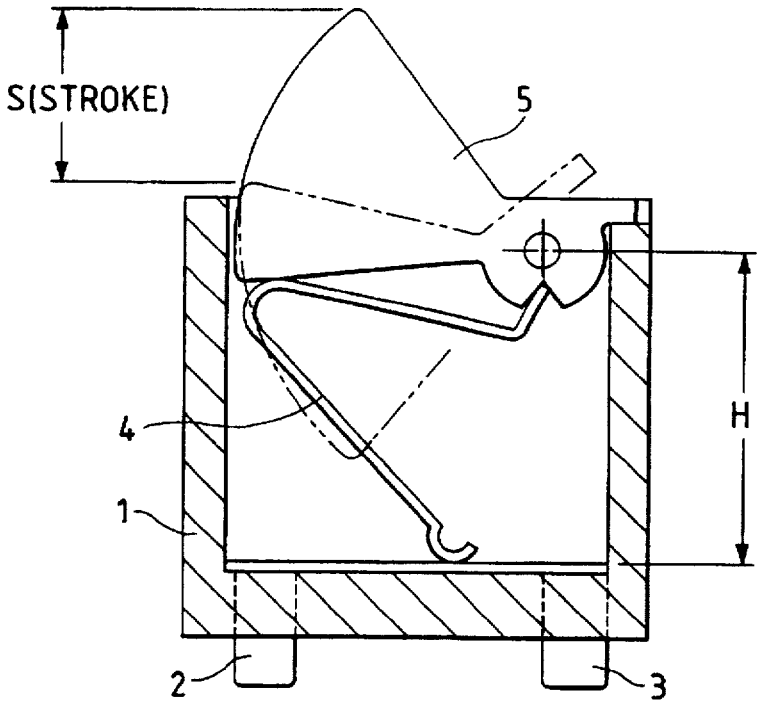
FIG. 18 is a cross-sectional side view illustrating inconveniences derived from the long stroke of the operational lever.

In general, as shown in FIG. 18, if a further large stroke "S" is required for operational lever 5, a front edge of operational lever 5 will approach the bottom of casing 1 when operational lever 5 is depressed down. To avoid interference between such a swing movement of operational lever 5 and casing, 1, it will be normally required to provide a deep bottom.

Figure 19:
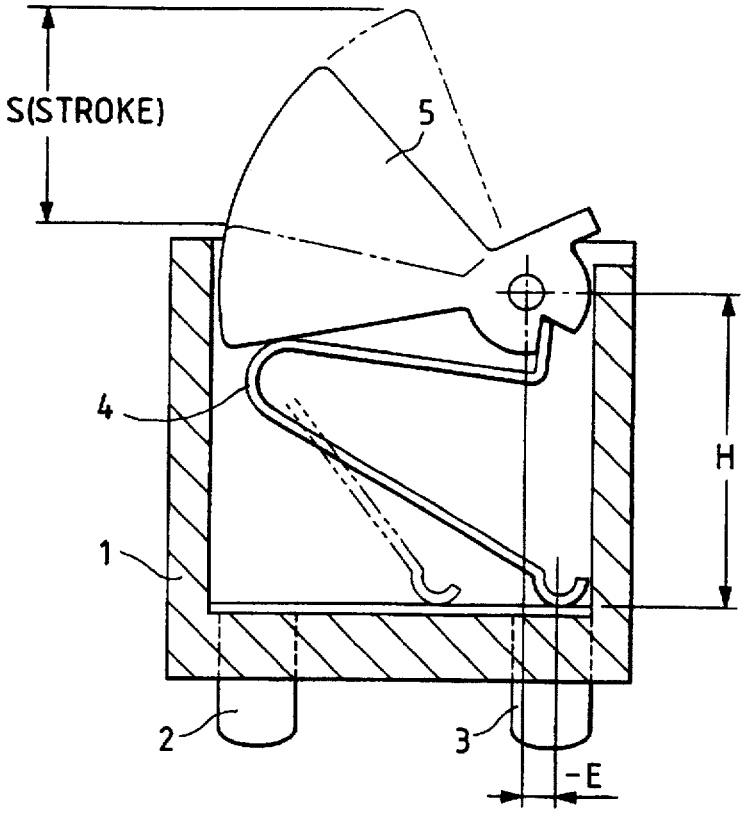
FIG. 19 is a cross-sectional side view showing the operational lever being depressed down.
Figure 20:
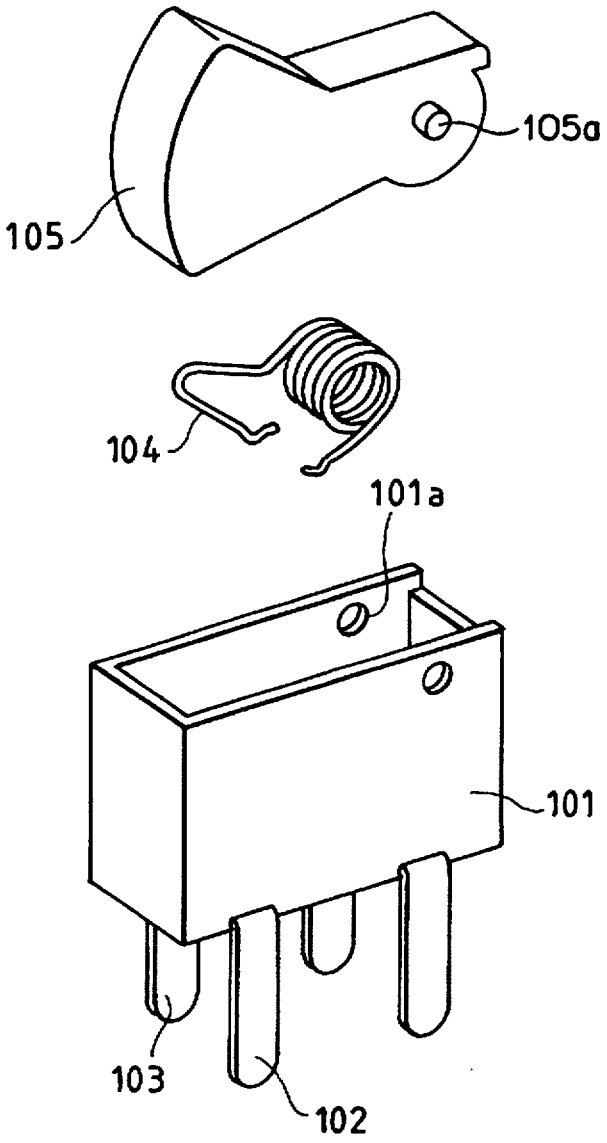
FIG. 20 PRIOR ART
FIG. 20 is an exploded perspective view showing a conventional lever switch.
Figure 21:
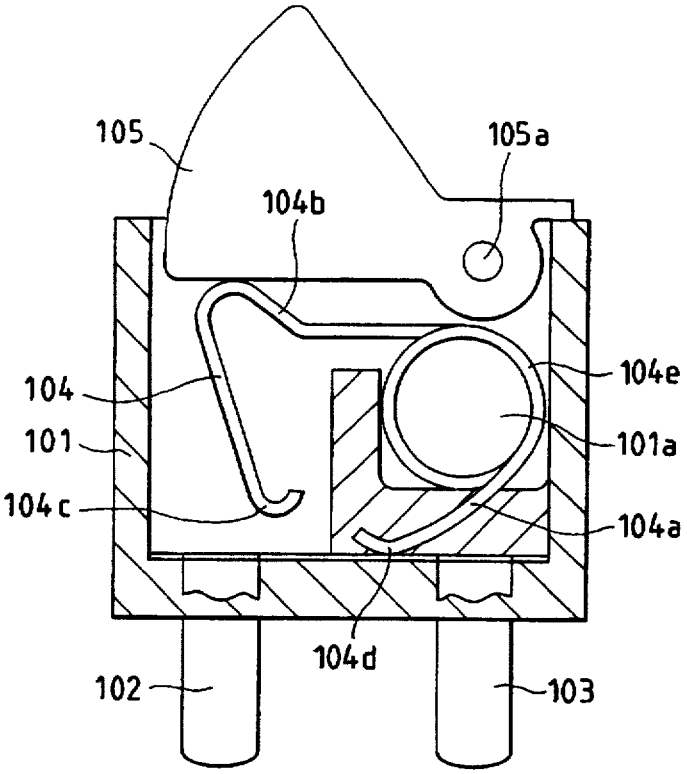
FIG. 21 PRIOR ART
FIG. 21 is a cross-sectional side view showing the conventional lever switch of FIG. 20.
Figure 22:
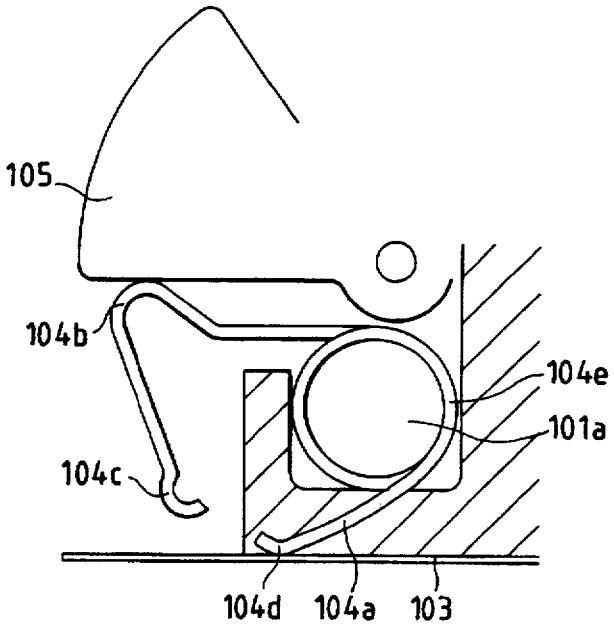
FIG. 22 PRIOR ART
FIG. 22 is a cross-sectional side view showing a normal condition of the conventional lever switch of FIG. 20.
Figure 23:
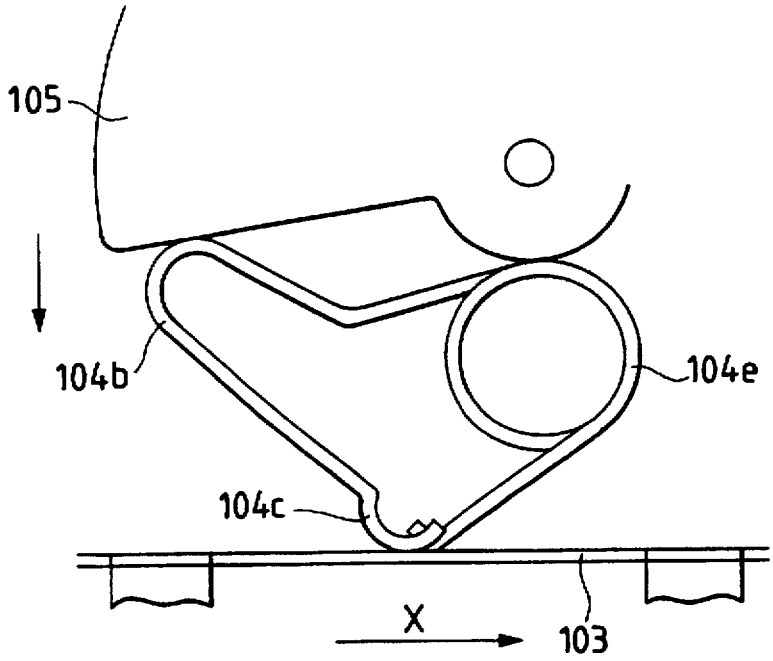
FIG. 23 PRIOR ART
FIG. 23 is a cross-sectional side view showing a transitional condition of the conventional lever switch of FIG. 20, where an operational lever is depressed to an intermediate position.
Figure 24:
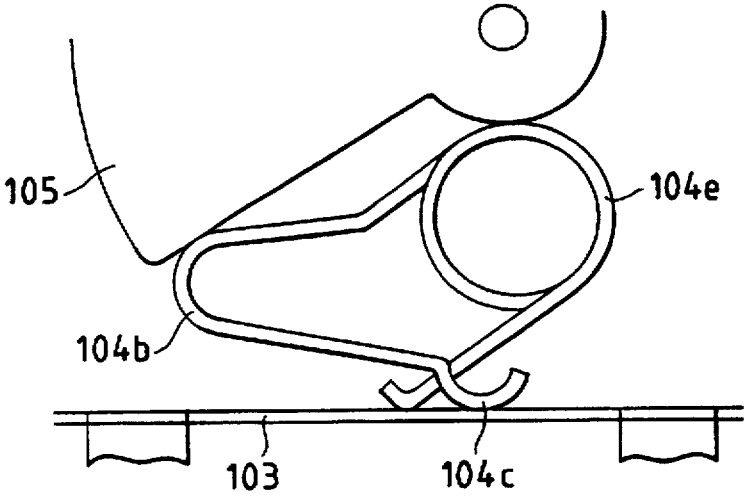
FIG. 24 PRIOR ART
FIG. 24 is a cross-sectional side view showing a final condition of the conventional lever switch of FIG. 20, where the operational lever is in a full-stroke position.

Hence, the distance "H" from the rotational center of operational lever 5 to the bottom of casing 1 is enlarged. As shown in FIG. 19, the contact point of contact piece 4 (represented by the distance "E" in FIG. 6) becomes negative during the stroke "S" of operational lever 5. When the distance "E" is a negative value, no restoring force is given to operational lever 5.

To solve this problem, an eighth embodiment of the present invention provides a lever switch whose casing has an inclined bottom. The casing arrangement of the eight embodiment can be applied to any of preceding first to seventh embodiments of the present invention.

Figure 14:
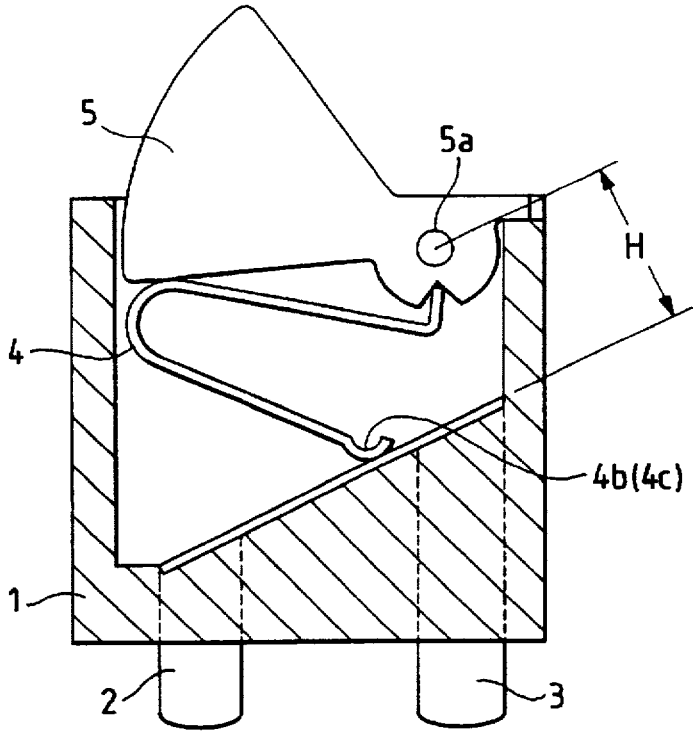
FIG. 14 is a cross-sectional side view showing a normal condition of a lever switch in accordance with the eighth embodiment of the present invention.
Figure 15:
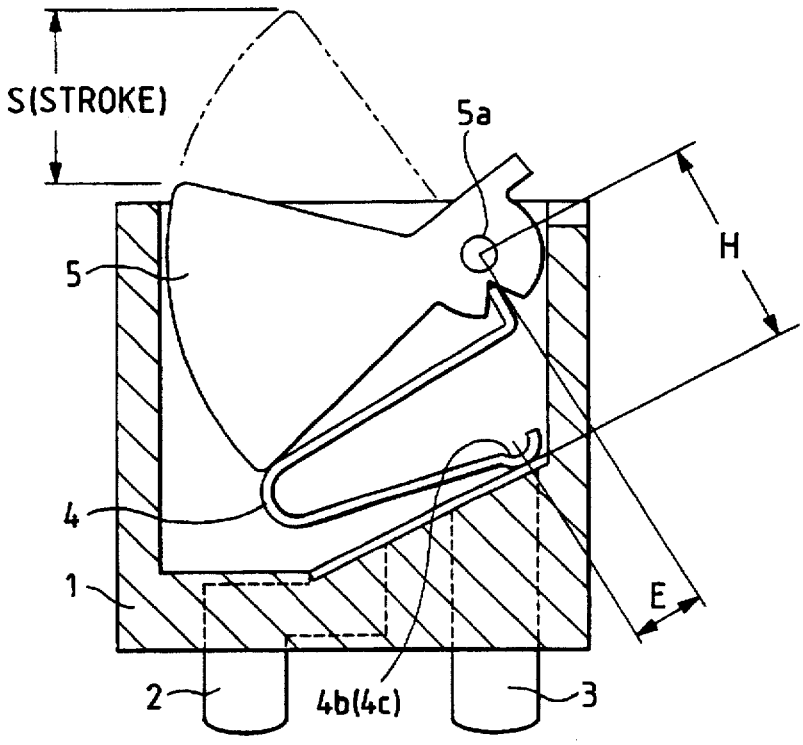
FIG. 15 is a cross-sectional side view showing an operated condition of the lever switch in accordance with the eighth embodiment of the present invention, wherein the operational lever is depressed fully.

More specifically, the bottom surface of casing 1 is formed into an inclined surface ascending from a far side to a near side with respect to the pivot boss 5*a* of operational lever 5. In other words, the bottom surface of casing 1 is an inclined surface which is low at a front end where the operational lever 5 is largely moved or swung and high at a portion where the contact portion of contact piece 4 is brought into contact with. With provision of this inclined bottom surface, a substantial distance "H" from pivot boss 5*a* of operational lever 5 to the bottom surface is fairly reduced as shown in FIG. 14. Hence, even if operational lever 5 is fully depressed by an amount of the stroke "S", the distance "E" from the pivot boss 5*a* of operational lever 5 to the movable contact 4*b*(4*c*) of contact piece 4 is surely kept at a positive value as shown in FIG. 15. Thus, operational lever 5 is always given a sufficient restoring force from resilient contact piece 4 when operational lever 5 is released from the depressing force.

Ninth Embodiment

Figure 16:
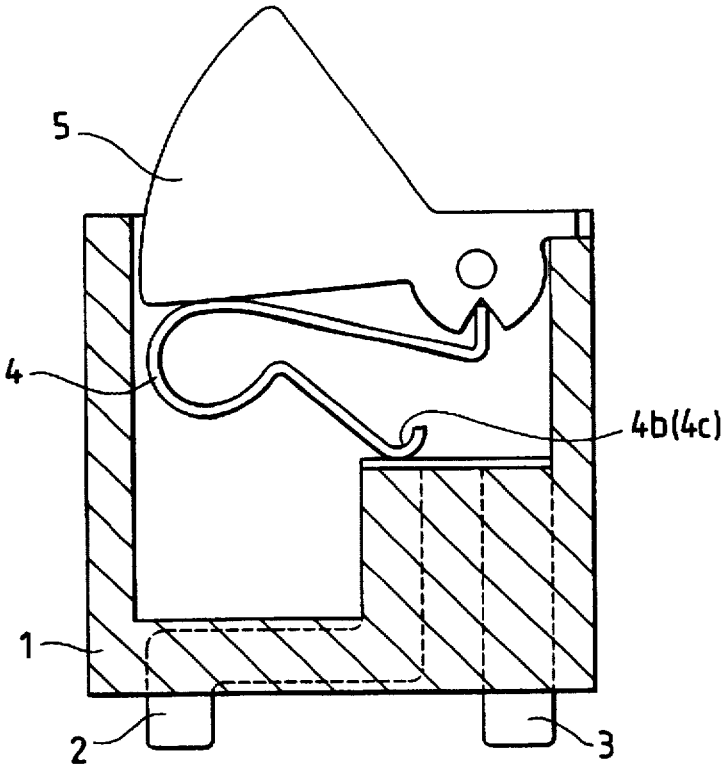
FIG. 16 is a cross-sectional side view showing a normal condition of a lever switch in accordance with a ninth embodiment of the present-invention.
Figure 17:
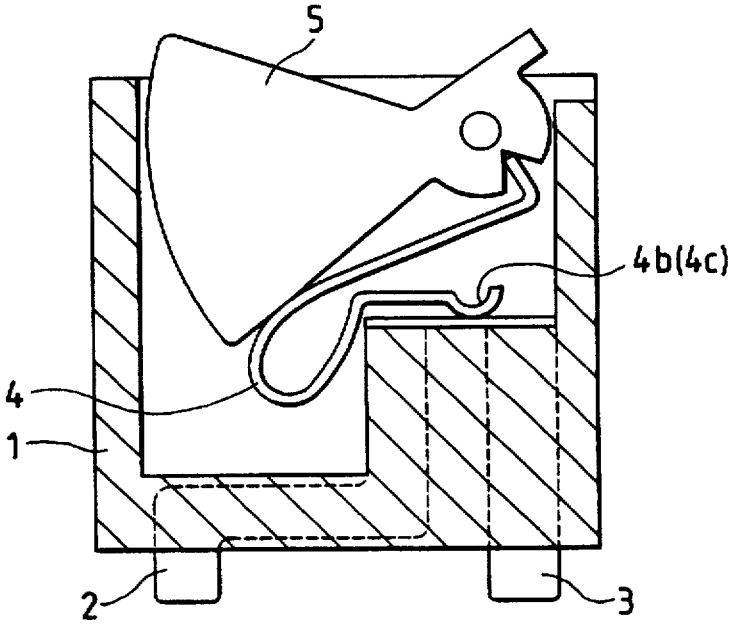
FIG. 17 is a cross-sectional side view showing an operated condition of the lever switch in accordance with the ninth embodiment of the present invention, wherein the operational lever is depressed fully.

A lever switch in accordance with a ninth embodiment of the present invention will be explained with reference to FIGS. 16 and 17.

The ninth embodiment is characterized in the configuration of the bottom of the casing, and can be applied to any of the preceding first to seventh embodiments of the present invention. More specifically, the bottom of casing 1 is formed into two-story steps. The movable contact 4*b*(4*c*) of contact piece 4 is always placed on the higher step so as to slide on it. When operational lever 5 is depressed deeply, the U-shaped portion of contact piece 4 enters into a space formed above the lower step, preventing the interference with the higher step, as shown in FIG. 17.

Combination of Embodiments

Although the above-described embodiments are independently explained, it is needless to say that the present invention also includes any combination of these embodiments.

As apparent from the foregoing description of the embodiments, the present invention provides the contact piece capable of causing a swing motion about the pivot boss of the operational lever in response to a rotation of the operational lever. Hence, it becomes possible to obtain a relatively large operational stroke with a relatively small deflection of the contact piece, without causing a plastic deformation of the contact piece. Furthermore, as the distal end of the contact piece is always placed on the inside surface of the casing so as to slide thereon, it becomes possible to assure a smooth and stable operational feeling.

In addition, the on-stroke accuracy of the operational portion does not depend on the manufacturing accuracy in bending contact piece 4. Hence, the contact piece can be formed into a simple configuration suitable for precision machining or processing. Thus, it becomes possible to provide a lever switch having excellent on-stroke accuracy, having parts easy to process or manufacture, simple in construction for facilitating installation, and realizing low cost.

As this invention may be embodied in several forms without departing from the spirit-of essential characteristics thereof, the present embodiments described are therefore intended to be only illustrative and not restrictive, since the scope of the invention is defined by the appended claims rather than by the description preceding them, and all changes that fall within metes and bounds of the claims, or equivalents of such metes and bounds, are therefore intended to be embraced by the claims.

What is claimed is:

1. A lever switch comprising:

a casing shaped into a box-like configuration with an open top and a bottom;

first and second terminals, each having a stationary contacts provided on said bottom of said casing;

an operational lever inserted from said open top of said casing and swingably supported on an upper part of said casing; and a contact piece resiliently deformable and disposed under said operational lever, said contact piece being formed into a U-shaped configuration, said U-shaped configuration having a first portion extending along the underside of said lever, and a second portion of said contact piece having one end provided with a movable contact said movable contact being brought into sliding contact with one of said stationary contacts of said terminal provided on said bottom of said casing, and a second contact maintained in continuous sliding contact with another of said stationary contacts as said one contact enters sliding contact with a respective stationary contact when said U-shaped configuration is deflected by said lever engaging said contact piece at the junction of said first and second portion whereby an electrical path is provided between said first and second terminals through said stationary contacts and said contact piece.

2. The lever switch in accordance with claim 1, wherein said bottom of said casing supports said contacts and has an inclined surface ascending from a far side to a near side with respect to a rotational center of said operational lever, so that said inclined surface is high at a portion near the rotational center of said operational lever and low at a portion near a distal end of said operational lever.

3. The lever switch in accordance with claim 1, wherein said contact piece is made of a thin plate and has one end separated into a plurality of ligulate pieces having said movable contacts at the distal ends thereof, and the other end having an engaging portion engageable with said operational lever.

4. The lever switch in accordance with claim 1, wherein said stationary contacts are provided on an inside wall of said casing, while said movable contact of said contact piece is provided on a ligulate piece bent perpendicularly from said contact piece of thin plate so as to extend toward said inside wall and to be resiliently brought into contact with said stationary contact.

5. The lever switch in accordance with claim 1, wherein said contact piece is made of a resiliently deformable wire so as to form a pair of U-shaped contact legs extending in parallel with each other, and said contacts of said contact piece are formed on a distal end of each contact leg.

6. The lever switch in accordance with claim 1, wherein said operational lever is provided with a pivot boss engageable with a bearing hole in said case serving as the rotational center of said operational lever, said contact piece has a pair of plates bent and raised from opposing sides of a base end of said contact piece, and a bearing hole is opened on the center of each plate to receive said pivot boss.

7. The lever switch in accordance with claim 1, wherein a base end of said contact piece is insert molded into said operational lever.

8. The lever switch in accordance with claim 1, wherein said contact lever is made of a resilient flat plate and separated into a plurality of ligulate pieces extending from its base end in a cantilever fashion, and at least one of said ligulate pieces is engaged at its distal end to said operational lever.

9. The lever switch in accordance with claim 1, wherein said contact piece includes a plurality of ligulate pieces having movable contacts on the distal ends thereof, and at least one of said ligulate pieces is shorter than others.

10. The lever switch in accordance with claim 1, wherein said inside bottom of said casing has a plurality of steps, and said movable contacts of said contact piece is always placed on a higher step while a U-shaped portion of said contact piece enters into a space formed above a lower step when said operational lever is depressed down.

11. A lever switch comprising:

a casing shaped into a box-like configuration with an open top and a bottom;

first and seconds terminals each having a stationary contact provided on said bottom of said casing;

an operational lever inserted from said open top of said casing and swingably supported on an upper part of said casing; and a contact piece made of a resiliently deformable and conductive thin plate and disposed under said operational lever, said contact piece comprising an engaging portion bent upward from a base end thereof, a movable portion bent downward at a middle thereof in a U-shaped configuration along the underside of said operational lever, and a ligulate piece separated at a remote end thereof so as to have movable at distal ends thereof, so that one of said movable contacts are brought into sliding contact with a respective stationary contact of said terminal provided on said bottom of said casing as the other of said movable contacts remains in continuous sliding contact with a respective stationary contact when said lever is moved against said movable portion.

* * * * *